US007731196B2

(12) United States Patent
Scoccia

(10) Patent No.: US 7,731,196 B2
(45) Date of Patent: Jun. 8, 2010

(54) TOSSED PROJECTILE GAME

(76) Inventor: Adelmo A. Scoccia, 2139 Ronda Grande, Unit 0, Laguna Woods, CA (US) 92637

( * ) Notice: Subject to any disclaimer, the term of this patent is extended or adjusted under 35 U.S.C. 154(b) by 0 days.

(21) Appl. No.: 12/117,169

(22) Filed: May 8, 2008

(65) Prior Publication Data

US 2008/0277874 A1 Nov. 13, 2008

Related U.S. Application Data

(60) Provisional application No. 60/928,555, filed on May 10, 2007.

(51) Int. Cl.
*A63F 9/00* (2006.01)

(52) U.S. Cl. ..... 273/348; 273/317

(58) Field of Classification Search ..... 273/317, 273/336, 338, 348; 473/569, 614, 590, 591
See application file for complete search history.

(56) References Cited

U.S. PATENT DOCUMENTS

| | | | | | |
|---|---|---|---|---|---|
| 341,831 | A | * | 5/1886 | Burns | 273/317 |
| 1,547,273 | A | | 7/1925 | Trayers | |
| 2,584,260 | A | * | 2/1952 | Custer | 473/591 |
| 2,922,650 | A | * | 1/1960 | Shepherd | 273/338 |
| D219,822 | S | * | 2/1971 | Rokaitis | D21/387 |
| 3,856,748 | A | | 4/1972 | Howard | |
| 3,685,826 | A | | 8/1972 | Lehman | |
| 3,690,660 | A | | 9/1972 | Olkowski | |
| 3,731,931 | A | | 5/1973 | Monaco | |
| 3,762,710 | A | * | 10/1973 | De Coninck | 473/591 |
| 3,823,942 | A | * | 7/1974 | Duncan | 473/514 |
| 3,826,499 | A | | 7/1974 | Lenkoff | |
| 3,862,513 | A | | 1/1975 | Isaacson et al. | |
| 3,892,407 | A | | 7/1975 | Higgins | |
| 3,917,269 | A | | 11/1975 | Paquette | |
| 4,012,037 | A | | 3/1977 | Kinser | |
| 4,012,042 | A | | 3/1977 | Blasingame | |
| 4,045,028 | A | | 8/1977 | Dyess | |
| 4,055,343 | A | | 10/1977 | Stuart | |
| 4,130,281 | A | | 12/1978 | Leber et al. | |
| 4,149,723 | A | * | 4/1979 | Simon | 273/348 |
| 4,198,048 | A | | 4/1980 | Rathert | |
| 4,243,229 | A | | 1/1981 | Huser et al. | |
| 4,261,578 | A | | 4/1981 | Grottola | |
| 4,314,702 | A | | 2/1982 | Updike et al. | |
| 4,392,653 | A | | 7/1983 | Blume, Sr. | |
| 4,458,902 | A | * | 7/1984 | Miller et al. | 473/591 |
| 4,491,327 | A | | 1/1985 | Morris | |
| 4,531,745 | A | | 7/1985 | Leidy | |

(Continued)

*Primary Examiner*—Raleigh W. Chiu
(74) *Attorney, Agent, or Firm*—Knobbe, Martens, Olson & Bear LLP

(57) ABSTRACT

A projectile having multiple openings for tossing onto a game field for encouraging and developing hand-eye coordination. The projectiles have plural fingers extending from a central hub of the projectile. The game field includes plural targets sized to fit within the projectile openings. Points are scored by using hand-eye coordination to toss the projectile so that it comes to rest on the field with one or more openings enclosing or partially enclosing a target or targets. This is a game that is safe and can be played indoors or outdoors by the entire family. The tossed projectile is designed to be lightweight and the targets are designed to minimize possible injury. The pegs can fold to a horizontal position in case of an accident.

16 Claims, 9 Drawing Sheets

U.S. PATENT DOCUMENTS 4,563,008 A * 1/1986 Fielden ..... 273/126 R
4,593,912 A 6/1986 Rivas et al.
4,635,943 A 1/1987 Lumpkin
4,673,186 A 6/1987 Walker
4,736,955 A 4/1988 Pollock
4,772,030 A * 9/1988 Hunt ..... 473/590
4,805,916 A 2/1989 Zentner, Jr.
4,819,947 A 4/1989 Mackey
4,863,175 A 9/1989 Ricks, Jr. et al.
4,877,256 A 10/1989 Falloon
4,880,242 A 11/1989 White
4,898,392 A 2/1990 Goletz
4,919,435 A * 4/1990 McKinney ..... 273/339
4,927,159 A * 5/1990 Morrissey et al. ..... 273/338
4,952,073 A 8/1990 Wieland
4,964,644 A 10/1990 Hull et al.
4,968,041 A 11/1990 Calvo
4,971,335 A 11/1990 Galvin
4,989,880 A 2/1991 Gettemeier et al.
5,002,286 A 3/1991 Wade et al.
5,016,891 A 5/1991 Nelson
5,018,745 A 5/1991 Dunse
5,026,054 A 6/1991 Osher et al.
5,040,307 A 8/1991 Dotson
5,040,801 A 8/1991 Weymuth
5,056,795 A 10/1991 Buhrow
5,067,727 A 11/1991 Crompton
5,082,288 A 1/1992 Swartz
5,123,656 A 6/1992 Green
5,125,669 A 6/1992 Kanda
5,135,232 A 8/1992 Moreau
5,180,171 A 1/1993 Panzica et al.
5,199,717 A * 4/1993 Wimmer ..... 473/590
5,201,526 A 4/1993 Ketcham, Jr.
5,286,034 A 2/1994 Haverkate et al.
5,290,040 A 3/1994 Boroski
5,290,041 A 3/1994 Kettelson
5,324,042 A 6/1994 Demas
5,333,879 A 8/1994 Barnes
5,401,027 A 3/1995 Surbeck
5,435,570 A * 7/1995 Labrasseur ..... 273/355
5,441,255 A 8/1995 Verbick
5,465,961 A 11/1995 Burtch
5,472,211 A 12/1995 McCaughan
5,516,114 A 5/1996 Michlin et al.
5,575,483 A 11/1996 Dineen et al.
5,660,389 A 8/1997 Freda, III
5,725,214 A 3/1998 Adams
5,776,021 A 7/1998 Rakonjac
5,800,237 A 9/1998 Cummings
5,865,681 A 2/1999 Tudek et al.
5,893,563 A 4/1999 Buller
6,135,455 A 10/2000 McNally
6,237,918 B1 5/2001 Williams
6,241,251 B1 6/2001 Trifonov
6,308,956 B1 10/2001 Reid
6,508,707 B2 1/2003 DeMar et al.
6,715,762 B2 4/2004 Simmons
6,746,327 B2 6/2004 Frohm et al.
6,773,014 B2 8/2004 Lynch
6,773,015 B2 8/2004 Long et al.
6,800,027 B2 10/2004 Giobbi et al.
6,814,679 B1 * 11/2004 Chen ..... 473/590
6,821,220 B2 * 11/2004 Engler, Jr. ..... 473/578
6,889,336 B2 5/2005 Schoenfeld et al.
6,889,982 B1 5/2005 Gove
6,988,964 B2 1/2006 Buckfield
6,997,828 B1 * 2/2006 Yang ..... 473/590
7,040,623 B2 5/2006 Poffenberger
7,134,662 B2 11/2006 Menendez
7,338,047 B2 * 3/2008 Kelley et al. ..... 273/317
2001/0031677 A1 * 10/2001 Coleman et al. ..... 473/569
2003/0092515 A1 * 5/2003 Darnell ..... 473/590
2006/0046878 A1 * 3/2006 Yang ..... 473/590
2007/0216102 A1 * 9/2007 Matilla et al. ..... 273/317
2008/0277874 A1 * 11/2008 Scoccia ..... 273/348

* cited by examiner

TOSSED PROJECTILE GAME

This application claims the benefit of U.S. Provisional Application 60/928,555 filed May 10, 2007, the entire contents of which is expressly incorporated herein by reference.

FIELD OF THE INVENTION

The present invention relates to a game in which projectiles are tossed onto a target.

SUMMARY OF THE INVENTION

A projectile having multiple openings is tossed onto a playing field having a plurality of targets. The projectiles have various sizes so that young children, older children and teenagers and adults can play. In one embodiment, the projectile has a multiple openings and the targets are circular shapes of different color and circular mounds of different color. In another embodiment, the targets also include vertical rods or pegs. An aspect of the game is to encourage and develop hand-eye coordination of both children and adults by practicing tossing of a projectile such that it lands on the playing field so that a target is within a projectile opening when the projectile has come to rest.

DETAILED DESCRIPTION OF THE PREFERRED EMBODIMENT

Figure 1:
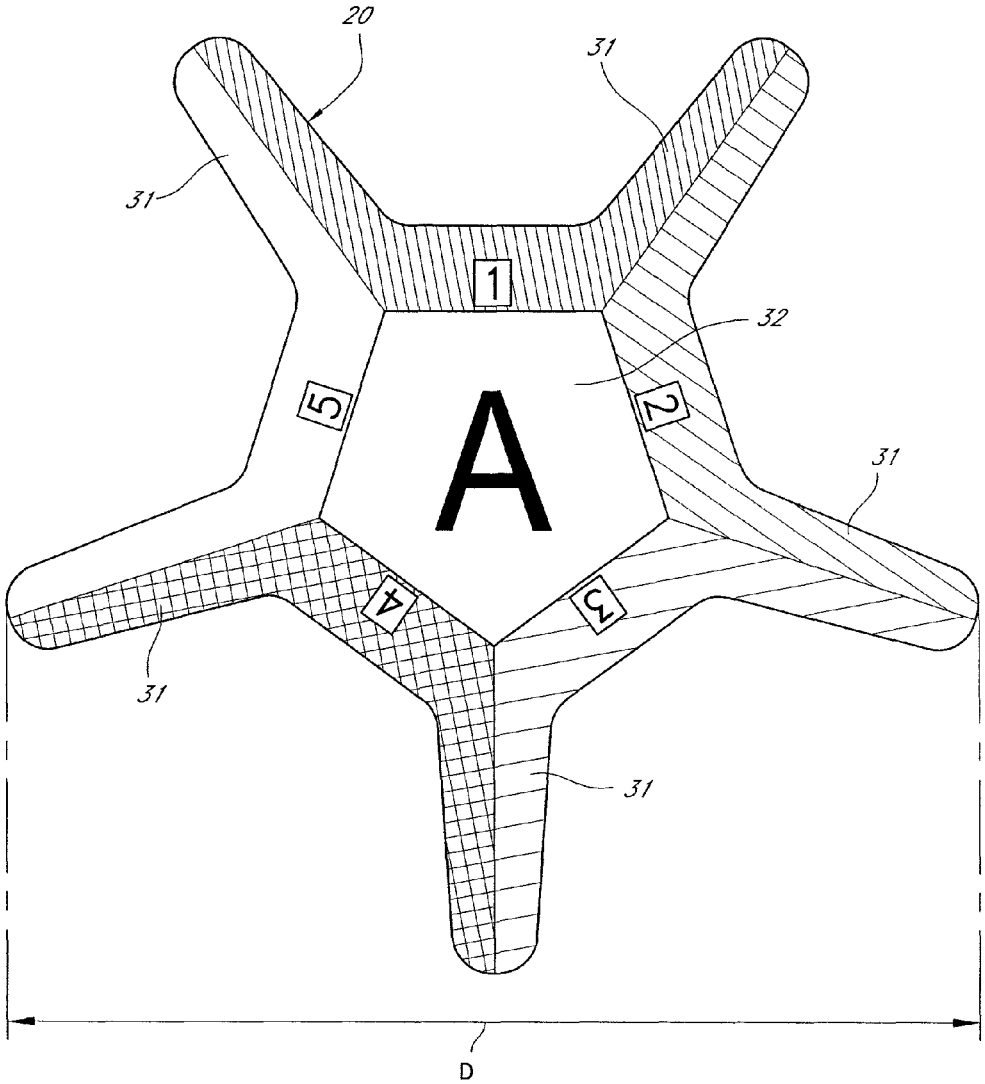
FIG. 1 illustrates a large projectile for older teens and adults.
Figure 2:
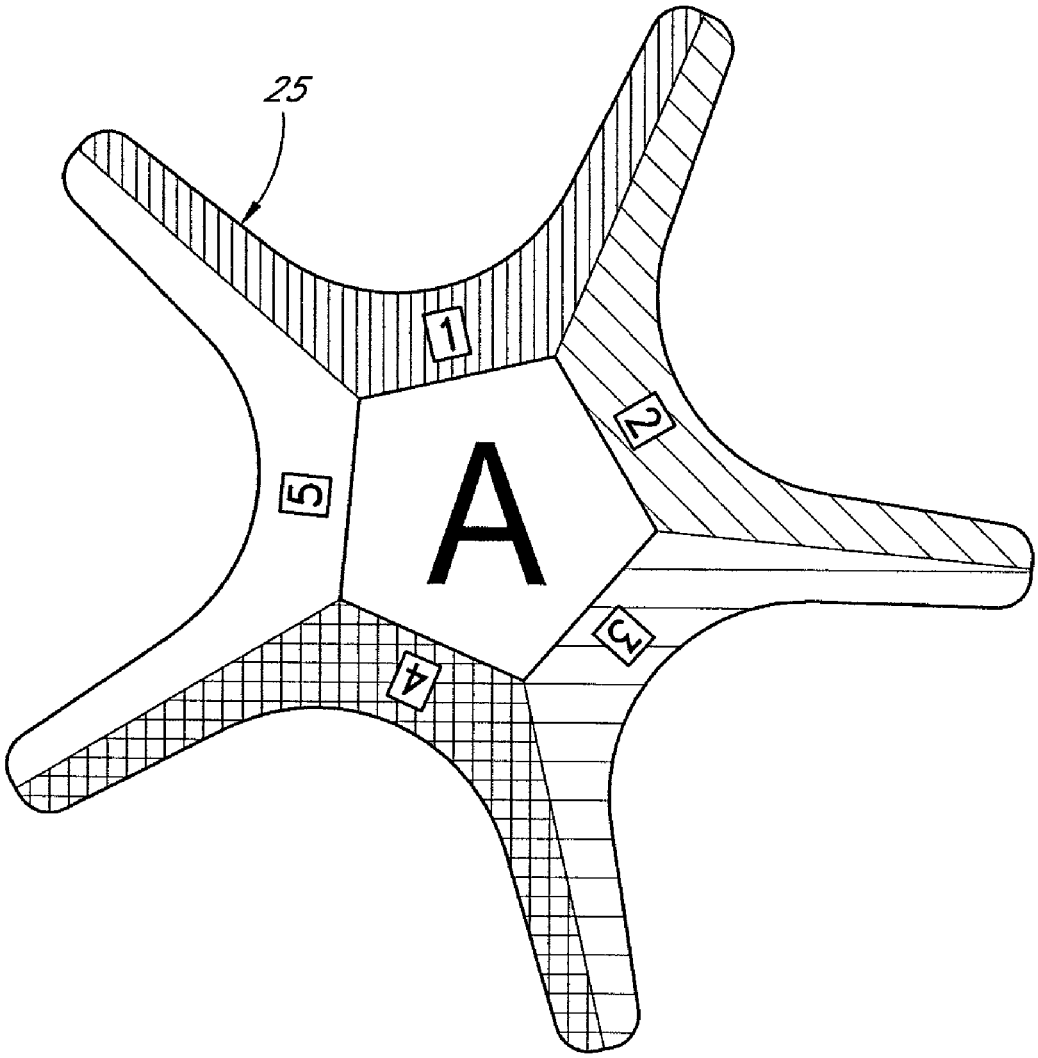
FIG. 2 illustrates a medium sized projectile for older children and younger teenagers.
Figure 3:
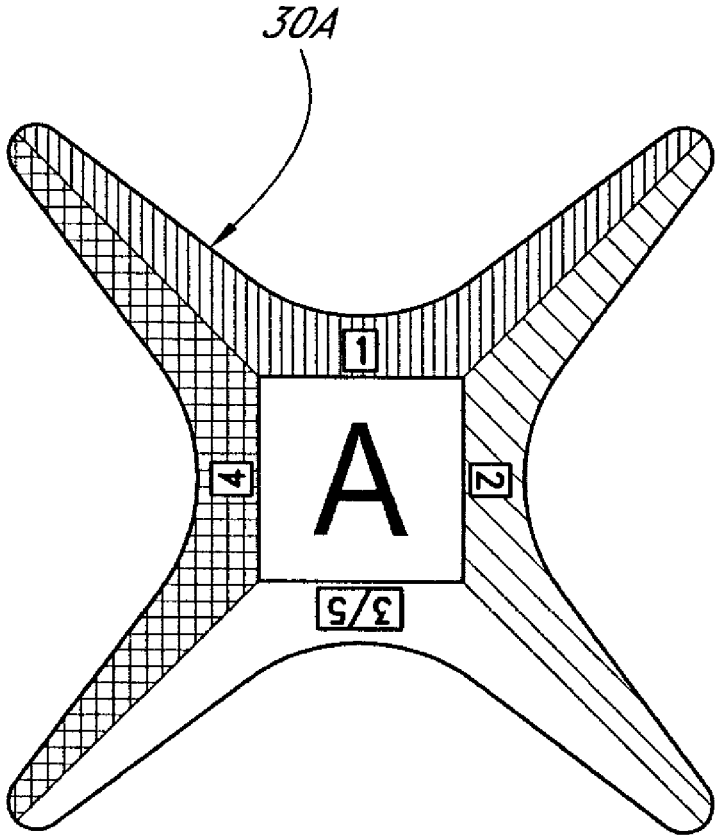
FIGS. 3 and 4 illustrate a small sized projectile for young children.
Figure 4:
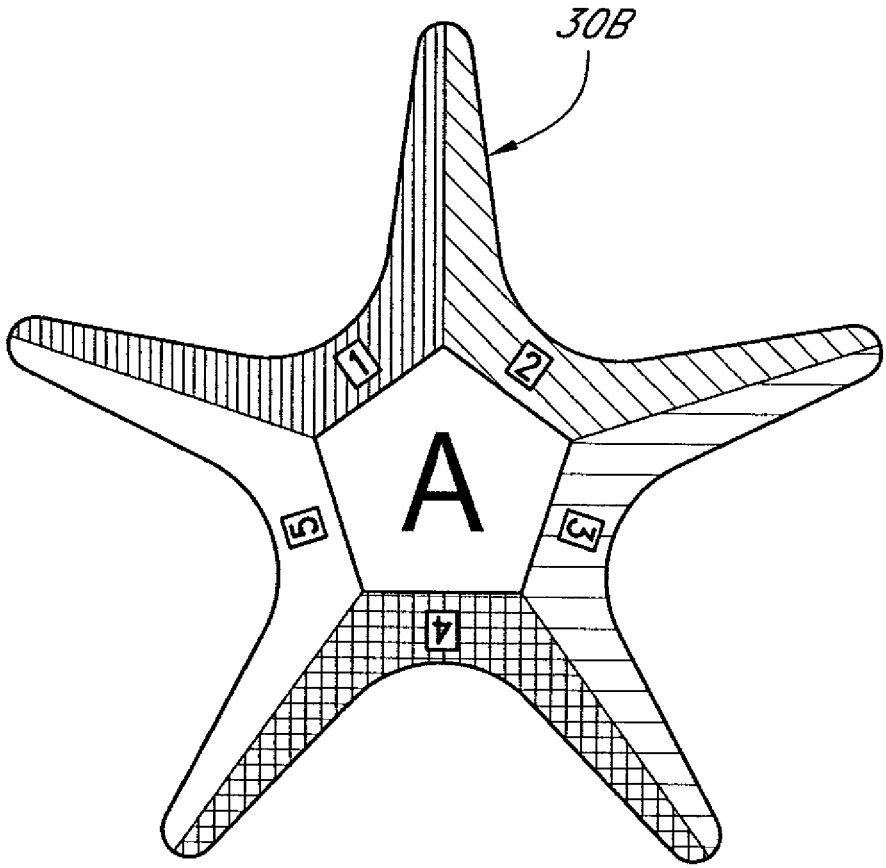

This game uses tossed projectiles referred to in this description as a "many opening projectile" or "mop." As described below, the projectiles have plural fingers forming plural openings. The distal ends of the fingers are connected to a central hub portion of the projectile. The mops can be used in games with points being scored when, after the projectile is tossed onto a game field, any one of the openings of the mop surrounds or partially surrounds a target.

Three various sized mops 20, 25, 30A, and 30B are shown in FIGS. 1, 2, 3 and 4. By way of specific example, the longest distance D between the tips of the five fingers 31 for the largest mop 20 is 7⅝ inches, for the mop 25 this distance is 5½ inches, for the mops 30A and 30B, this distance is 4½ inches. The reason for the various sized mops is to provide a game that the entire family can enjoy. The small size mops

30A, 30B are designed for a child from 5 to 10 years old, the medium size 25 is for a child from 11 to 16 years, and the large size 20 is for players from 17 years and on. The age limits as noted are for guidance purposes and are not fixed or limited to the specific examples described and illustrated. In embodiments described, the mop of FIGS. 1, 2 and 4 has five fingers 31 forming five openings and the mop 30B of FIG. 3 has four fingers forming four openings. In the embodiments illustrated, the projectile is symmetrical with fingers 31 being evenly spaced and of equal length. It will be understood that the number of openings and the size of the mops are not fixed. The classification of three age groups is not fixed and the players may indeed decide to use several mops of the same size for players of all ages. Alternatively, this game may be played with the players selecting what size, shape, weight or material of mop they would like to play with.

The mops 20, 25 and 30A and 30B may be cut from rigid or semi-rigid sheets of suitable material including wood, plastic, and fiber board with distal ends of fingers 31 integrally attached to a central hub portion 32. They are advantageously light in weight and have no sharp corners so that even young children can play the game.

Figure 5:
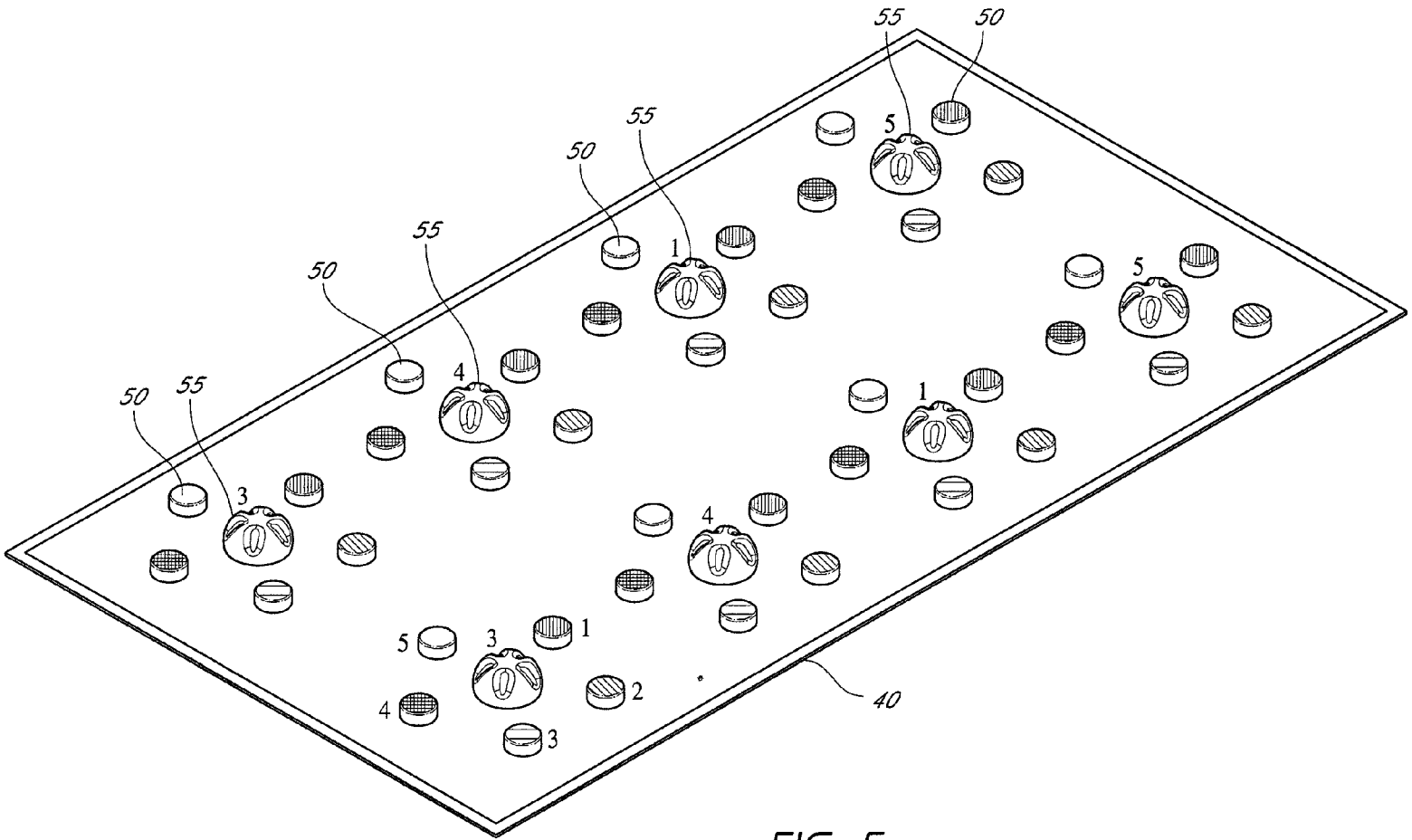
FIG. 5 illustrates one embodiment of a game sheet having target colored shapes (tcs) and target colored mounds (tcm).

The game playing field can be provided by a game sheet. One embodiment of a game sheet 40 is shown in FIG. 5. A plurality of targets are placed on this sheet. In this embodiment, the targets include plural small flat circular shapes 50 of different colors approximately 1¾ inches in diameter and one half inch high (referred to as a "target colored shape or" "tcs") and small circular mounds 55 of different colors approx. 3 inches in dia. and approx. 1 inches high (referred to as a "target colored mound" or "tcm"). In the embodiment shown, the targets can be set up with eight colored targets tcm 55 and five colored tcs targets 50 spaced in a circular pattern around each tcm 55. By way of specific example, the border dimensions of one game target sheet 40 is approx. 54 in.×38 in. The game sheet material can be clear transparent plastic vinyl of medium thickness so that the material rolls easily into an approx. 5 in. dia. roll. These are not fixed dimensions and can vary to suit the location and desires of the user. Other embodiments can be a rigid game board or a folding game board. The tcs and tcm targets can be attached to the game sheet or game board. However, this is not a requirement and these targets can be provided with weighted bases allowing the targets to be free standing and individually positioned by the game players on any surface such as a floor, sidewalk or patio or the targets can be magnetized with respect to the game sheet.

Typical colors used in this embodiment can be red (A), green (B), blue (C), yellow (D), and black (E). Advantageously, all of the colors can have numbers marked on them, e.g. red is 1, green is 2, blue is 3, yellow is 4 and black is 5 and avoids any problem if a player is color blind. The fingers 31 of the mops can advantageously use the same colors and in the same order as red, green, blue, yellow and black. In one embodiment, the color combinations are used in scoring. Thus, if a mop 20, 25, 30A or 30B is tossed so that any two fingers 31 surround a target tcs 50 or tcm 55 of the same color or same number, then the points can be doubled or add one point. The player can make this decision of one or two points. In addition at the same time the other fingers of that same mop can be in scoring position also. See FIG. 6 for an example of multiple scoring by one single mop.

Figure 7:
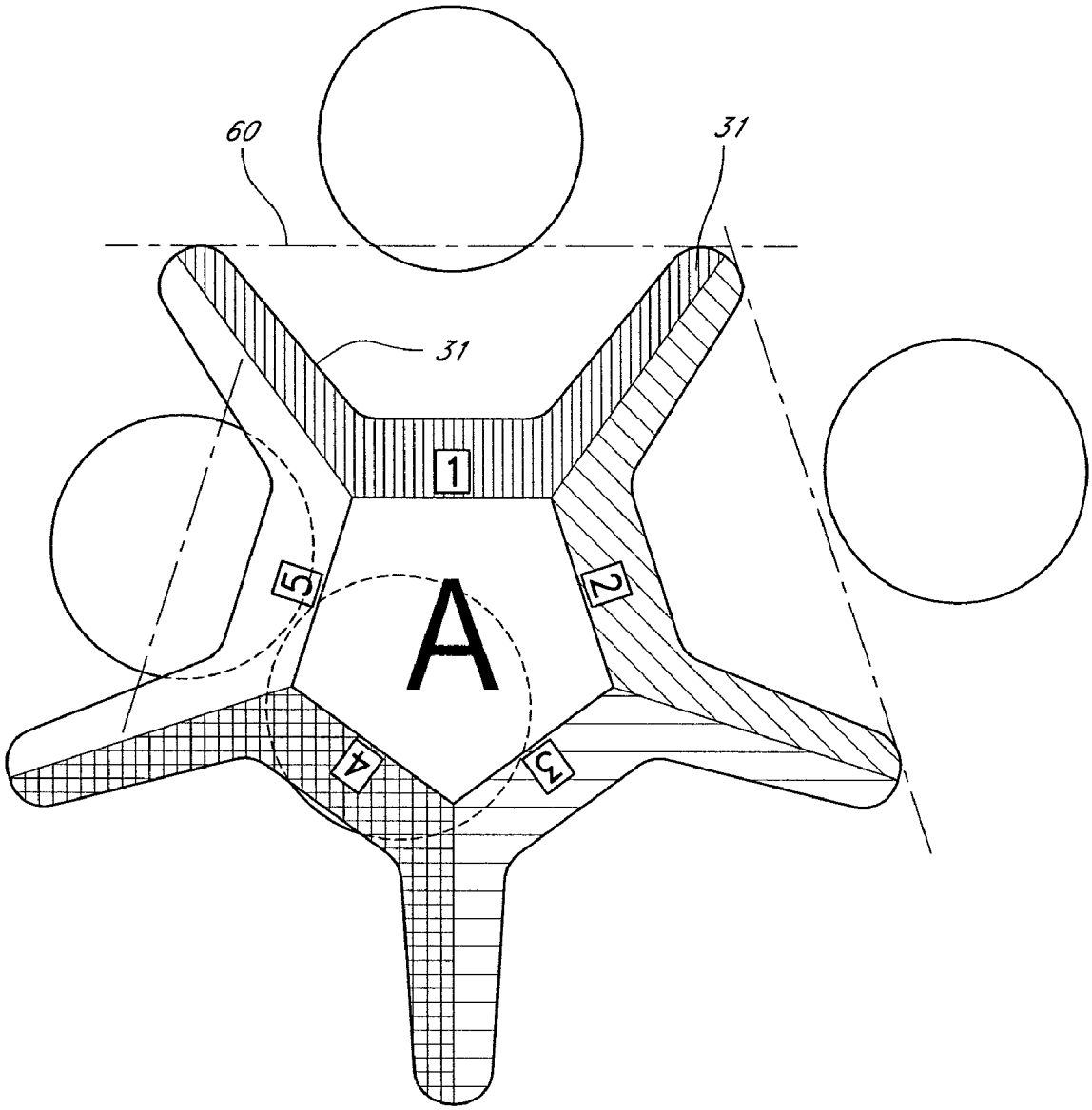
FIG. 7 illustrates the scoring of points after a projectile has come to rest on the game sheet.

Sometimes it may be difficult to decide if the mop 20, 25, 30A or 30B is close enough to score. This can be decided by, as shown in FIG. 7, placing the edge of a ruler or straight edge 60 in line with the tips of the two fingers 31 of the mop and if the straight edge intersects a part of the target then it counts as a valid score.

Figure 6:
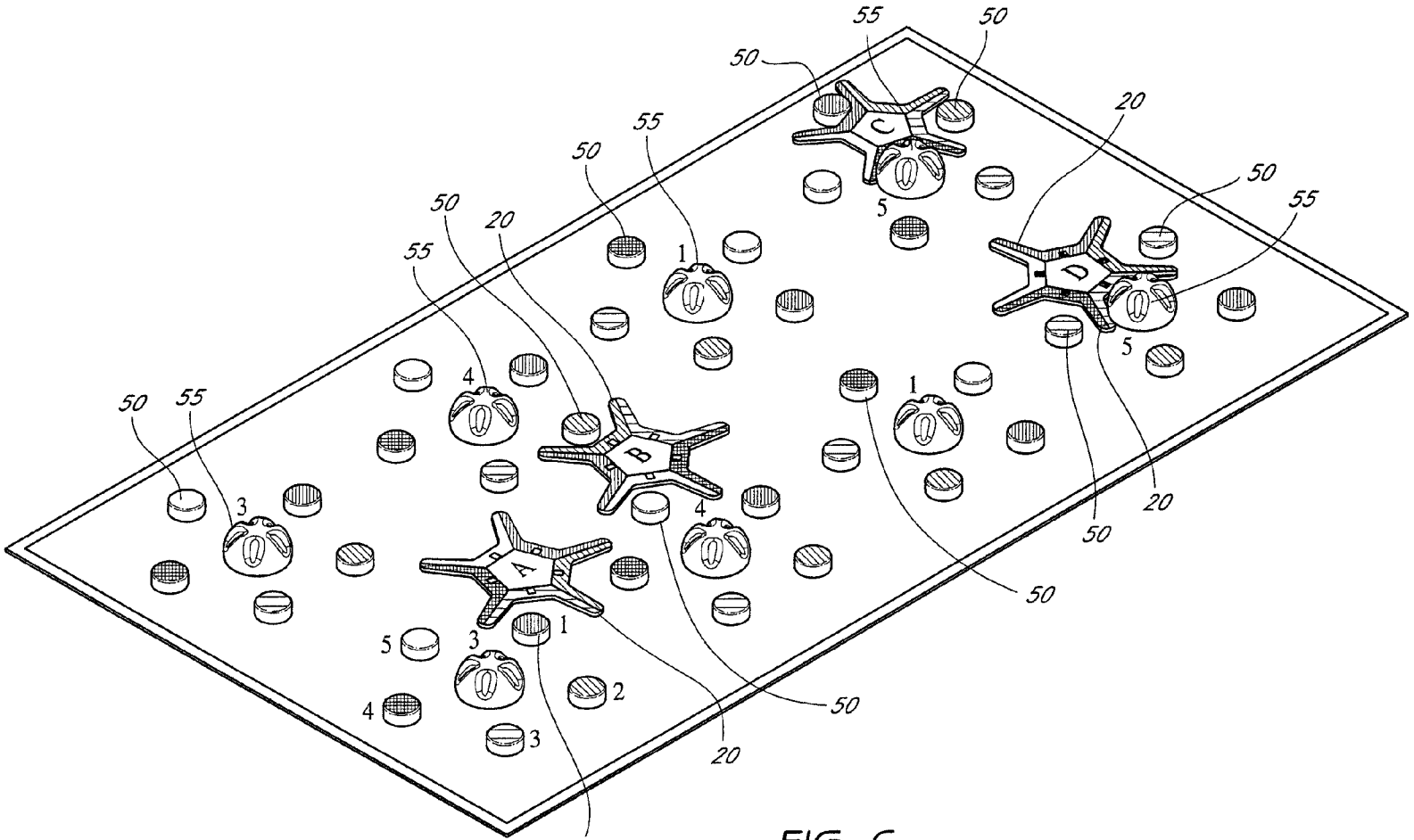
FIG. 6 illustrates the game sheet with four large projectiles in play.

Scoring of a representative game is illustrated in FIG. 6. The four mops 20 labeled A, B, C and D are in play after having been tossed and come to rest on the game sheet 40. Points are scored beginning with mop 'A' having scored two points because its blue opening is around a red tcs 50. Mop 'B' has scored eight points because its black opening is around a black tcs 50 for four points and its green opening is around a green tcs 50 for four more points. Mop 'C' has scored twelve points because its yellow opening is around a yellow tcm 55 for six points and its red opening is around a red tcs for four points and its blue opening is around a green tcs for two points. Finally mop 'D' has scored seven points because its blue opening is around a black tcm for three points and its yellow opening is around a blue tcs for two points and a green opening is around a blue tcs for two points.

Typically, the players are required to toss the mops behind a toss line a few feet from one end of the sheet 40. The players may use more than one toss line to accommodate players of different ages so that younger players will be able to toss closer to the sheet 40 than the older players. For example, children, 1 foot, teenagers, 3 feel, and adults, 5 feet.

The game can be played in a number of ways while training hand-eye physical coordination of the players. For example, one player plays against another player or a team game where two players play against two other players. The players can agree to each having so many tosses and then compare the scores of each player. The player with the highest score after the agreed number of tosses wins the game. If more than one player tosses the mop on the same target, the rules can specify that both players get credit for the points they scored. Thus, one player's mop tossed on the other player's mop does not need to cancel the other player's score. Such scoring is uncomplicated because the colors usually do not match between the two mops.

The game can provide both great family fun and hand-eye coordination development. Since there are three different sizes of mops each person in the family can toss their two respective mops and each player's score is recorded. Then after so many agreed tosses the winning score is determined. Another way to play is with partners so that each partner tosses two mops at the targets and the points are recorded. Then the following partners do the same and their points are recorded. This can be done with two or more sets of partners. The winner can be decided by the partners who arrive at a certain number of points first. For example thirty points for adults and twenty points for children. The winning number can change to suit the players. Still another way to play is to award the partners with the highest number of points after ten tosses of the mop as the winner.

The game can also be played with each player scoring as individuals. For example, each player tosses two or four mops followed by the next player. Again the points earned are recorded for each player and the winner is decided by whoever reaches a given point or the highest score after so many tosses. If any openings of the mop surrounds one of the raised tcms, that counts for three points. Every time a mop is thrown there is a possibility of a color match up with one of the targets tcm or tcs. When that occurs then the points are increased by 1. For example the tcm points would be 4 and the tcs points would be 3. In a game with partners, one player and his opponent may have their mop surround the same target. In one embodiment, both players will get points for it because one player may have a color match and his opponent does not, i.e., in the example, you cannot cancel your opponents score just because two players surround the same target.

Another way to play the game is let each player toss two or four mops and then count their score and retract their mops before the next player throws the same two or four mops and counts their score. In that way there is no interference with the other player's mops on the playing field and no problem with identification. The winner of this game may be decided upon by the highest score of the player or players or if it is a team game after the agreed number of tosses have been reached. This has the advantage of avoiding a long drawn out game.

There are many other ways to play this game. For example parents versus children or girls versus boys.

In other embodiments of the games, the size of the game target area, the number of tcms, tcs' and how they are arranged and located can be modified. In another embodiment, everyone in the family can play with one target area or they can have a target area designed by them by providing a game with movable tcm and tcs can be moved to suit their desires.

In another embodiment, especially advantageous for children, special picture tcs' on the game sheet have pictures of animals, of cartoons, of movie stars and of educational subjects like mathematics. If any of the openings of the mop surrounds any one of these tcs the players receive two points and if they can give the correct name of the picture or answer the math question they will receive one additional point. In addition, if the color of the opening of the mop matches the color of the tcs, the player will receive one additional point. In this example the player could have earned four points. Two points for the mop surrounding a special picture tcs, one point for matching colors, and one point for answering the question correctly on the special picture tcs.

In another embodiment, the scoring of a mop is not determined by color but by a number. Scoring is provided by numbers rather than by colors shown in the previous Figures. This embodiment will assist use by color blind players. This embodiment can also be used to assist teaching small children about numbers while playing the game.

Figure 8:
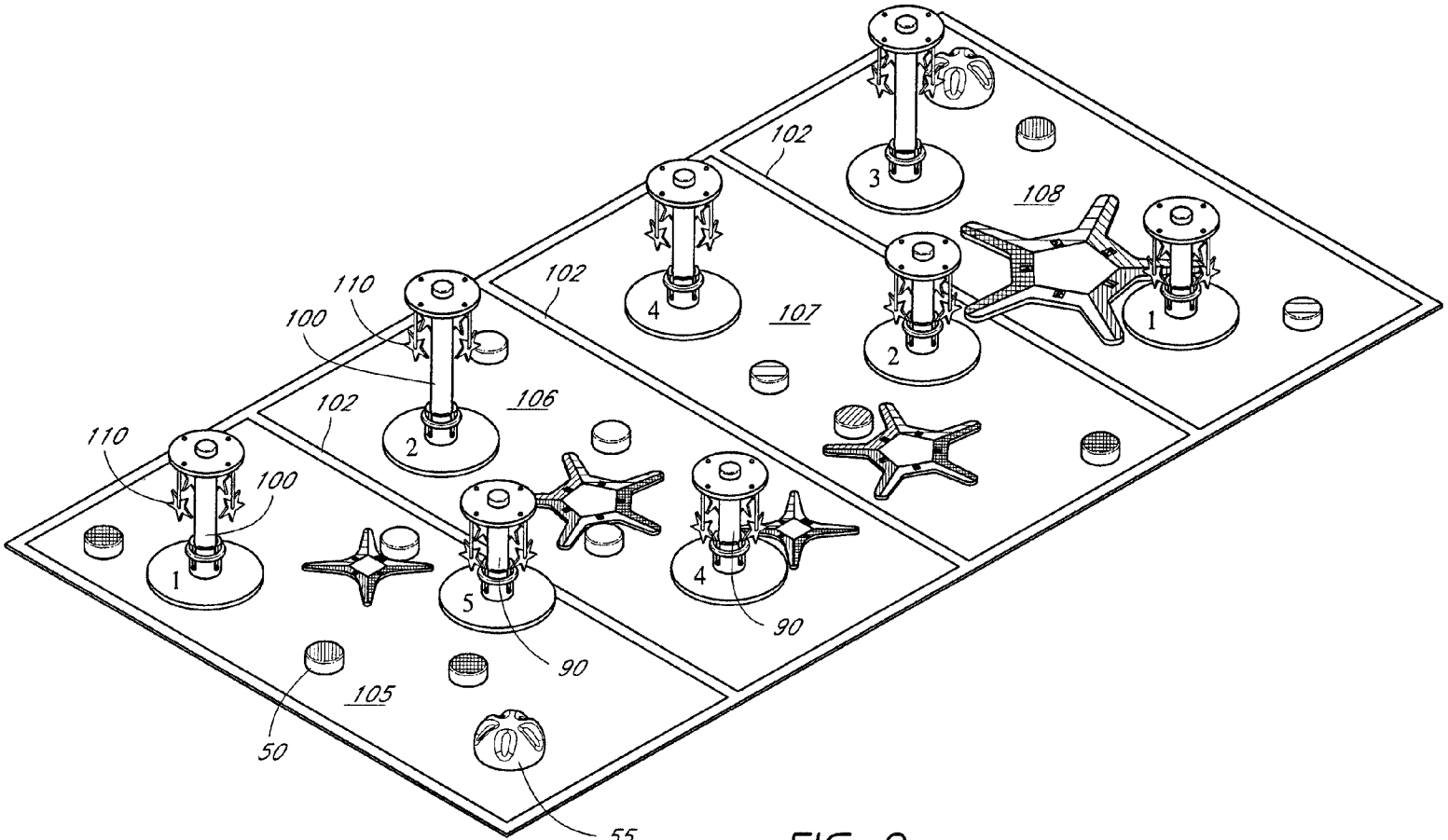
FIG. 8 illustrates another embodiment of a game sheet having target colored shapes (tcs), target colored mounds (tcm), upstanding plain target pegs and upstanding target pegs with dangling stars.
Figure 9:
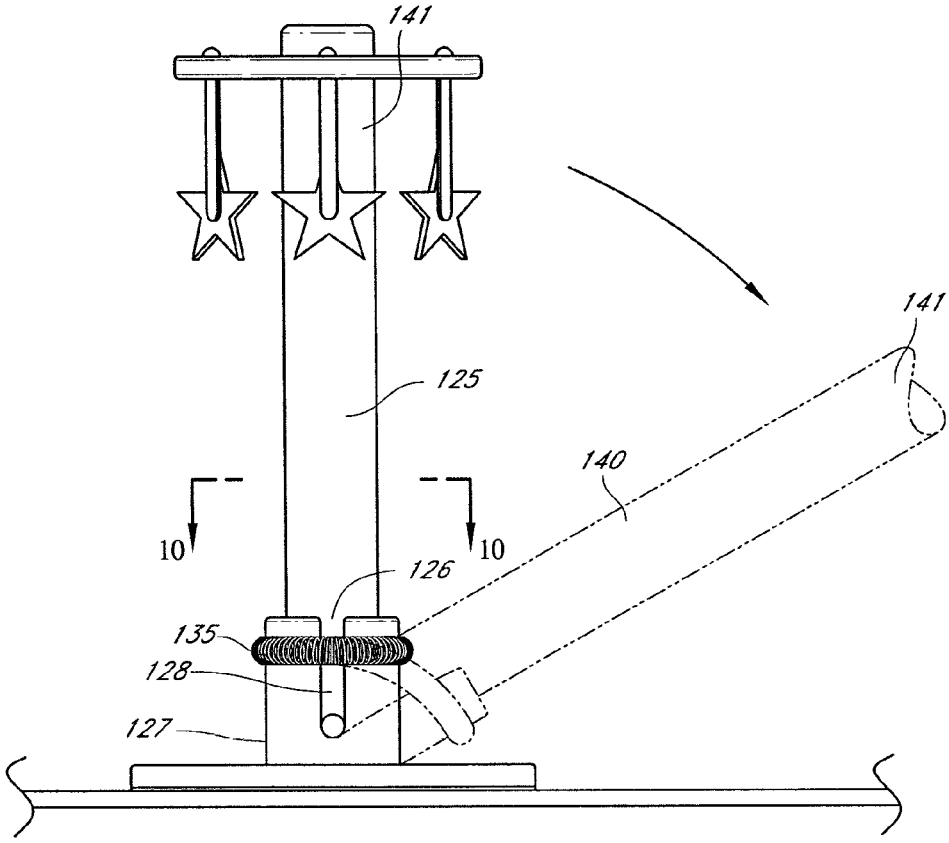
FIG. 9 is a side elevation view of an embodiment of an upstanding target peg that folds if fallen upon by a player.
Figure 10:
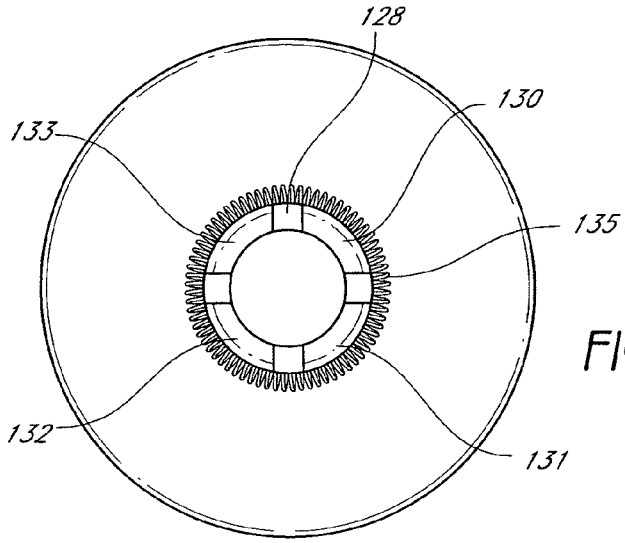
FIG. 10 is a top elevation view of the folding target peg shown in FIG. 9.

Another embodiment of the game is illustrated in FIGS. 8, 9, and 10. This embodiment includes upstanding target pegs 90 and 100 in addition to the tcs and tcm targets 50 and 55. In this embodiment, the playing field is advantageously provided by a sheet 101 divided by imprinted lines 102 into four sections 105, 106, 107 and 108 with a scattered display of targets within each section. The exciting and challenging fun of the game can be further enhanced by employing game rules requiring that the player does not receive points from targets nor can the player progress to the next section until the player accomplishes a "Catch A Shining Star (referred to hereinafter as "Cass)" by successfully tossing a projectile so that its opening surrounds an upstanding shining star target peg 100 distinguished by its taller peg and dangling stars 110.

FIGS. 9 and 10 further illustrate an embodiment of the dangling star target peg 100 which is designed to fold if, per chance, a child or adult would fall onto the target. As shown, the cylindrical peg 125 is retained at its distal end 126 within a base 127 formed from a resilient plastic or rubber material. As shown in one embodiment, the base 127 is configured as a generally cup shaped member having slots 128 which form four curved cup sections 130, 131, 132, and 133. A circular spring 135 biases each of the sections 130, 1312, 132, and 133 against the distal end 126 of peg 125 to normally retain peg 125 in a vertical position. However, if a person falls onto the cylindrical peg 125, one or more of the resilient leaves of the cup 127 will open up and allow peg 125 to bend from its normally vertical position toward a horizontal position as shown at 140 and thereby deflect the proximal end 41 of tube 125 from its upright vertical position to a safer horizontal position. It will be apparent that the safety cup holder 127 can also be advantageously used to support each of the shorter plain target pegs 90.

Referring to FIG. 8, the four plain target pegs 90 are approximately 4 inches high and the shining star target pegs 100 are approx. six inches high. The four pegs 100 are spaced in a row with a number of the small shiny colored stars 110 dangling from the top of each peg 100. The smaller pegs 90 with no stars and other tcs and tcm targets are scattered in each section. In one play mode, the object of each player is to initially toss a mop to Cass in the first section, i.e. toss a mop so that an opening of the mop surrounds the peg 100 in section 105 section. Not until the player does so do the points count and the player can progress to the next section 106. Once a player has reached the final section 108 by having used a mop 24, 25, 30A or 30B to Cass or "Catch A Shining Star" successfully in each of the previous sections 105, 106 and 107, the playing rules can, for example, allow this payer to be challenged by one of the other players on total accumulated points at that time in the game. The player with the highest points gains a turn and the other player losses a turn. After a player has completed the fourth segment that player has only one throw per turn at a special target to win the game. The remaining player or players continue to have their designated throws during their turn. If there is a tie then the player with the highest point score is the winner. A tie means two players have Cass in their final section and both players have Cass on their final toss to win.

In one embodiment, each peg 100 that supports the shiny stars will have a separate color and a corresponding number. This color and identifying number will provide the player with an extra point if they match with the mop. The Cass of the correct peg in each section will count four points. The mop that is thrown can land on top of a target or lean on a target and that counts as one point only. A lean does not gain an extra point if it matches the target. The targets can be marked by color and number so if the mop turns over the numbers are present on both sides of the mops. The other side of the mop has a neutral color with numbers. This is excellent for any player who has a difficulty distinguishing colors.

An exemplary mode of play for the games of FIG. 8 for encouraging and developing hand-eye coordination is as follows: The first player tosses four mops at the base of the peg 100 in the first section 105. If the player Cass then the player counts each target he has played and scored and records the points. The player then picks up the mops and gets ready to throw three mops at the next section 106 and tries to Cass the peg 100 in Section 106. If the player is successful to get a Cass then the player records the points he has scored, picks up the mops and proceeds to throw two mops at the third section 107 and tries to Cass the next peg 100 in this section 107. If the player is successful to get a Cass then he records the points, picks up the two mops and proceeds to throw one mop only this time at the base of the peg in the fourth section 108. If the player is successful to get a Cass then he records this score and his final score, and picks up the one mop. The player is now in position to make one throw at a final target which will be to Cass a designated peg and win the game. But at this point in the game another player may challenge the lead player for higher total points. The winner gains an extra turn and the loser in points losses a turn. Remember a player at any of the four sections must stay playing at that section and does not progress until the player Cass in that section. In this version of the rules, the game becomes more difficult as the player progresses section to section. Thus, in the beginning, the payer has four mops to toss; at the second section, the player has three mops to toss; at the third section the player has only two mops to toss and at the last or fourth section the player has only one mop to toss. From the fourth section and on the player has only one mop to toss and once the fourth section is completed the player does not accumulate any more points. When a player is not able to Cass in any section, the player loses his turn in that section and the score is the same until the next turn.

Other embodiments of the game enable different sports games. When the player enters the third and fourth sections or more, the game can become a sports game. For example, it can become a football game; a soccer game; a hockey game; a basketball game, golf, etc. The game can also become a double header by going from one game to the start of another game.

The shape and size of the basic game plans as depicted here are not fixed. For example the golf game plan would typically not lend itself to a fixed square or rectangular area throughout the game. The beauty of having various games that can be easily rolled up or stored in a handy location is important. All of these games will keep safety in mind for children and adults.

Although the foregoing systems and methods have been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. While certain embodiments of the inventions have been described, these embodiments have been presented by way of example only, and are not intended to limit the scope of the inventions. Indeed, the novel methods and systems described herein may be embodied in a variety of other forms without departing from the spirit thereof. Accordingly, other combinations, omissions, substitutions and modifications will be apparent to the skilled artisan in view of the disclosure herein.

For example, in the various sports or various other games that are possible, the targets and the projectiles may change to suit the type of game that is being played. The surface of the playing area and the targets may be such so as to retard the projectiles from jumping around upon making contact with those surfaces. The design, shape, thickness and material of the targets and projectiles as depicted here are only one version of this game. The layouts and arrangements of the targets as depicted in FIG. 5 were designed to provide an easier and higher scoring arrangement. This is an excellent game for beginners. The layouts and arrangements with the four sections of the playing field as depicted in FIG. 8 were designed in conjunction with the use of Cass. This is a more challenging game for more experienced players. By changing target locations and arrangements one can provide challenging and interesting games to satisfy different players and the whole family.

What is claimed is:

1. A tossed projectile game, comprising a game playing field, a plurality of targets comprising plural upstanding members projecting above said playing field, plural substantially flat circular shaped members projecting above said playing field, and plural mound shaped members projecting above said playing field, and a plurality of projectiles, each projectile having a plurality of fingers extending out from a hub of said projectile, wherein points are earned by landing a projectile on said game playing field so that one or more openings of the projectile surround or partially enclose one or more of said targets, said circular shaped members, or said mound shaped members.

2. A tossed projectile game, comprising a game playing field, a plurality of targets, wherein said plurality of targets comprises a plurality of mound shaped members, and a plurality of projectiles, each projectile having a plurality of fingers extending out from the center of said projectile, wherein points are earned by landing a projectile on said game playing field so that one or more targets lie within openings defined between adjacent fingers of the projectile.

3. The tossed projectile game of claim 2 wherein said plurality of targets include a plurality of substantially flat circular shaped members.

4. The tossed projectile game of claim 2 wherein said targets include a plurality of substantially vertical target pegs extending above said game playing field.

5. The tossed projectile game of claim 4 wherein said target pegs comprise a plurality of dangling reflective stars attached to a proximal end of each peg.

6. The tossed projectile game of claim 4, wherein each of said target pegs are mounted in a flexible base configured to cause the target peg to fold at its distal end such that the target peg moves from a substantially vertical position to a substantially horizontal position.

7. The tossed projectile game of claim 2 wherein said projectiles have a minimum of four extending fingers to form a minimum of four openings.

8. The tossed projectile game of claim 7 wherein said projectiles have a maximum opening larger than a maximum cross-sectional dimension of each of the plurality of targets.

9. The tossed projectile game of claim 2, wherein the game playing field comprises a game sheet.

10. The tossed projectile game of claim 9, wherein the game sheet comprises a retardant surface to minimize sliding of the projectiles after landing.

11. The tossed projectile game of claim 9, wherein the game sheet is constructed of flexible material capable of being rolled up or folded.

12. The tossed projectile game of claim 9, wherein the plurality of targets are fixedly attached to the game sheet.

13. The tossed projectile game of claim 2, wherein the plurality of targets are removably coupled to the game playing field such that the plurality of targets can be placed in any desired arrangement on the game playing field.

14. The tossed projectile game of claim 2, wherein the game playing field is divided into a plurality of sections, each section including at least one of the plurality of targets.

15. The tossed projectile game of claim 2, wherein the plurality of targets comprise different colors and each of the openings of the projectiles are colored with at least one of the colors of the targets, wherein additional points are earned by landing the projectile such that the color of an opening of a scoring projectile matches the color of the target lying within the opening.

16. The tossed projectile game of claim 2, wherein one or more of the plurality of targets comprise weighted bases such that the one or more targets are freestanding and can be placed in any desired arrangement on the game playing field.

* * * * *

UNITED STATES PATENT AND TRADEMARK OFFICE

CERTIFICATE OF CORRECTION

PATENT NO. : 7,731,196 B2
APPLICATION NO. : 12/117169
DATED : June 8, 2010
INVENTOR(S) : Adelmo A. Scoccia It is certified that error appears in the above-identified patent and that said Letters Patent is hereby corrected as shown below:

On the Title Page 2, Item (56) 2nd column under U.S. Patent Documents, please delete "6,889,336 05/2005 Schoenfeld et al" and insert therefore -- 6,899,336 05/2005 Michelet et al. --

At column 3, line 21, please delete "feel," and insert therefore, -- feet, --

Signed and Sealed this
Thirteenth Day of March, 2012

David J. Kappos

David J. Kappos
*Director of the United States Patent and Trademark Office*